US006419025B1

(12) United States Patent
Lohbeck et al.

(10) Patent No.: US 6,419,025 B1
(45) Date of Patent: Jul. 16, 2002

(54) METHOD OF SELECTIVE PLASTIC EXPANSION OF SECTIONS OF A TUBING

(75) Inventors: Wilhelmus Christianus Maria Lohbeck, Rijswijk (NL); Timothy John Frank, Houston, TX (US); Robert Joe Coon, Houston, TX (US); Gregory Richard Nazzal, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/289,928

(22) Filed: Apr. 9, 1999

(51) Int. Cl.[7] ..... E21B 29/00
(52) U.S. Cl. ..... 166/380; 166/277; 166/207
(58) Field of Search ..... 166/299, 380, 166/384, 277, 381, 207, 212

(56) References Cited

U.S. PATENT DOCUMENTS

| | | | | |
|---|---|---|---|---|
| 3,162,245 A | | 12/1964 | Howard et al. | |
| 3,167,122 A | | 1/1965 | Lang | |
| 3,203,483 A | | 8/1965 | Vincent | |
| 3,326,293 A | | 6/1967 | Skipper | |
| 3,489,220 A | | 1/1970 | Kinley | |
| 3,720,262 A | | 3/1973 | Grable | |
| 3,785,193 A | | 1/1974 | Kinley et al. | |
| 5,014,779 A | | 5/1991 | Meling et al. | |
| 5,031,699 A | | 7/1991 | Artynov et al. | |
| 5,083,608 A | | 1/1992 | Abdrakhmanov et al. | |
| 5,348,095 A | * | 9/1994 | Worrall et al. | 166/380 |
| 5,366,012 A | | 11/1994 | Lohbeck | |
| 6,012,523 A | * | 1/2000 | Campbell et al. | 166/277 |
| 6,135,208 A | * | 10/2000 | Gano et al. | 166/313 |

FOREIGN PATENT DOCUMENTS

| | | |
|---|---|---|
| CH | 609401 | 2/1979 |
| GB | 2276648 | 10/1994 |
| WO | 93/25799 | 12/1993 |

OTHER PUBLICATIONS

*Metal Forming–Mechanics and Metallurgy*, Chapters 3 and 17, 2nd Ed., Prentice Mail, New Jersey, 1993.

* cited by examiner

*Primary Examiner*—Frank S. Tsay

(57) ABSTRACT

A method of selective plastic expansion of sections of a tubing to create one or more recesses in the tubing with a larger diameter than that of the original tubing in which the tubing is radially symmetrically or asymmetrically expanded at one or more locations by application of a radial force to the interior of the tubing thereby inducing a plastic radial deformation of the tubing and removing said radial force from the interior of the tubing.

12 Claims, 1 Drawing Sheet

METHOD OF SELECTIVE PLASTIC EXPANSION OF SECTIONS OF A TUBING

FIELD OF THE INVENTION

The invention relates to selective plastic expansion of tubings. More particularly the invention relates to selectively expanding a steel tubing to create recesses in the tubing by application of a radial force to the interior of the tubing.

BACKGROUND OF THE INVENTION

Numerous methods and devices are known for expansion of tubings.

PCT patent application WO 93/25799, published Dec. 23, 1993, discloses a method of expanding a casing against the wall of an underground borehole wherein the casing is made of a malleable material which preferably is capable of plastic deformation of at least 10% unaxial strain and the casing may be expanded by an expansion mandrel which is pumped, pulled or pushed through the casing.

Other expansion methods and devices are disclosed in German patent specification No. 1583992 and in U.S. Pat. Nos. 3,203,483; 3,162,245; 3,167,122; 3,326,293; 3,785,193; 3,499,220; 5,014,779; 5,031,699; 5,083,608 and 5,366,012.

Many of the known expansion methods employ an initially corrugated tube and the latter prior art reference employs a slotted tube which is expanded downhole by an expansion mandrel.

The use of corrugated or slotted pipes in the known methods serves to reduce the expansion forces that need to be exerted to the tube to create the desired expansion.

SUMMARY OF THE INVENTION

It is an object of the present invention to provide a method for selective expanding an at least partly solid, i.e. unslotted, tubing which requires exertion of a force to expand the tubing and which provides a tubing having at one or more sections a larger diameter and possibly higher strength than the unexpanded tubing and which can be carried out with a tubing which already may have a tubular shape before expansion.

The present invention therefore relates to a method of selective plastic expansion of sections of a tubing to create one or more recesses (cavity bulges) in the tubing with a larger diameter than that of the original tubing in which the tubing is radially symmetrically or asymmetrically expanded at one or more locations by application of a radial force to the interior of the tubing thereby inducing a plastic radial deformation of the tubing and removing said radial force from the interior of the tubing.

BRIEF DESCRIPTION OF THE DRAWINGS

The present invention will now be described, by way of example, with reference to the accompanying drawings, in which:

Referring to FIGS. 1 and 2, a borehole 10 is shown extending into a underground formation 12 and a cylindrical steel casing 14 of smaller outer diameter that the diameter of the borehole is positioned substantially concentrically within the borehole. An expansion tool 16 is lowered into the casing to the desired level and actuated, for example by pumping hydraulic fluid from the surface through tubing 18, to outwardly deform the casing 14 forming expansions or recesses 20, 22. FIG. 2 shows the borehole and expanded casing after the expansion tool 16 has been removed and downhole devices 24, 26 placed in the respective expanded recesses 20, 22 so that the inner diameter of the casing 14 is effectively not reduced.

DETAILED DESCRIPTION

Figure 1:
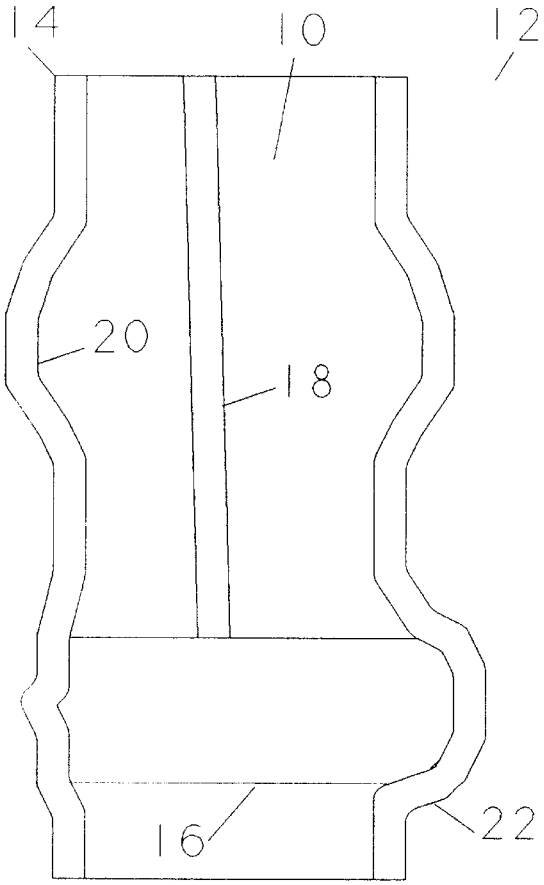
FIG. 1 is a diagrammatic vertical section through a portion of a well showing the creation of extended portions or recesses in the tubing.
Figure 2:
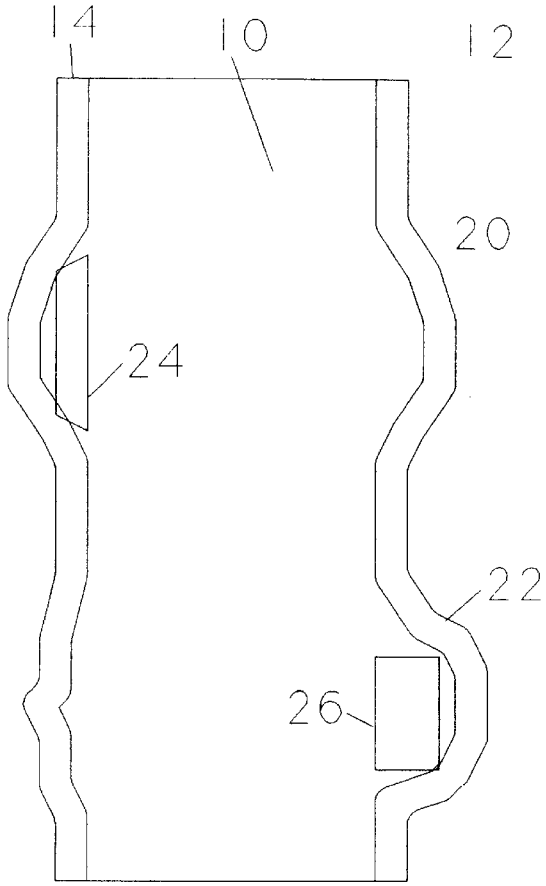
FIG. 2 is a similar diagrammatic vertical section showing the expanded structure with downhole devices mounted therein so as to not obstruct the inner diameter of the bore.

The radial force to the interior of the tubing is preferably exerted by means of an expandable tool which has been moved through the tubing to the section which has to be expanded. The expandable tool is suitably an expandable mandrel, e.g. a cone or roller system which can be expanded at the intended location, but it may also be an expandable hydraulic packer or a steel reinforced bladder which can be expanded by using hydraulic pressure.

The expandable tool can advantageously be operated at an internal pressure of at least 200 bar. The selective plastic expansion according to the present invention can, also be achieved through a localized explosion.

The tubing is suitably a downhole tubing and the created recesses using the method according to the present invention are advantageously utilized to hold at least one downhole device. Such a device is preferably a gas lift mandrel or a sensor. The downhole tubing is suitably situated within a completion liner or a production casing and is selectively expanded without restricting the overall ID of the tubing.

The tubing may be made of almost all types of steel, but preferably the tubing is made of a high-strength steel grade with formability and having a yield strength-tensile strength ratio which is lower than 0.8 and a yield strength of at least 274 MPa. When used in this specification, the term high-strength steel denotes a steel with a yield strength of at least 275 MPa.

It is also preferred that the tubing is made of a formable steel grade having a yield stress/tensile stress ratio which is between 0.6 and 0.7.

Dual phase (DP) high-strength, low-alloy (HSLA) steels lack a definite yield point which eliminates Luders band formation during the tubular expansion process which ensures good surface finish of the expanded tubular.

Suitable HSLA dual phase (DP) steels for use in the method according to the invention are grades DP55 and DP60 developed by Sollac having a tensile strength of at least 550 MPa and grades SAFH 540 D and SAFH 590 D developed by Nippon Steel Corporation having a tensile strength of at least 540 MPa.

Other suitable steels are the following formable high-strength steel grades:

- an ASTM A106 high-strength low-alloy (HSLA) seamless pipe;
- an ASTM A312 austenitic stainless steel pipe, grade TP 304 L;
- an ASTM A312 austenitic stainless steel pipe, grade TP 316 L; and
- a high-retained austenite high-strength hot-rolled steel (low-alloy TRIP steel) such as grades SAFH 590 E, SAFH 690 E and SAFH 780 E developed by Nippon Steel Corporation.

The above-mentioned DP and other suitable steels each have a strain hardening exponent n of at least 0.16 which allows an expansion of the tubing such that the external diameter of the expanded tubing is at least 5% larger than the external diameter of the unexpanded tubing.

Detailed explanations of the terms strain hardening, work hardening and the strain hardening exponent n are given in chapters 3 and 17 of the handbook "Metal Forming-Mechanics and Metallurgy", 2nd edition, issued by Prentice Mail, New Jersey (USA), 1993.

Suitably, the tubing is selectively expanded such that the outer diameter of the selectively expanded tubing is slightly smaller than the internal diameter of a liner or casing that is present in the borehole and any fluids that are present in the borehole and tubing ahead of the expansion tool are vented to surface via the annular space that remains open around the tubing after/during the selective expansion process.

The invention also relates to a wellbore provided with a tubing which has been selectively expanded using the method according to the invention.

We claim:

1. A method of selective plastic expansion of sections of an unslotted tubing of high-strength steel grade with formability having a yield strength-tensile strength ratio less than 0.8 and a yield strength of at least 274 MPa to create one or more recesses in the tubing with a larger diameter than that of the original tubing, said method comprising the steps of inserting into said tubing an expandable tool;

symmetrically or asymmetrically radially expanding the tubing at one or more locations by utilizing said tool to apply a radial force to the interior of the tubing thereby inducing a plastic radial deformation of the tubing; and removing said radial force and said tool from the interior of the tubing.

2. The method of claim 1, wherein the expandable tool is an expandable mandrel or an expandable hydraulic packer having a steel reinforced bladder.

3. The method of claim 1, wherein the expandable tool can be operated at an internal pressure of at least 200 bar.

4. The method of claim 1, wherein the tubing is a downhole tubing and the created recesses are utilized to hold at least one downhole device.

5. The method of claim 4, wherein said device is a gas lift mandrel or a sensor.

6. The method of claim 1, wherein the tubing is situated within a completion liner or a production casing and is selectively expanded without restricting the ID of the tubing.

7. The method of claim 1, wherein the tubing is made of a steel having a yield strength-tensile strength ratio which is between 0.6 and 0.7.

8. The method of claim 1, wherein the tubing is made of a dual phase (DP) high-strength low-alloy (HSLA) steel.

9. The method of claim 8, wherein the tubing is made of Sollac grade DP55 or DP60 having a tensile strength of at least 550 MPa or Nippon grade SAFH 540 D and SAFH 590 D.

10. The method of claim 1, wherein the tubing is made of a formable high-strength steel grade which is selected from the following group of steel grades:

an ASTM A106 high-strength low-alloy (HSLA) seamless pipe;

an ASTM A312 austenitic stainless steel pipe, grade TP 304 L;

an ASTM A312 austenitic stainless steel pipe, grade TP 316 L; and a high-retained austenite high-strength hot-rolled steel, which is known as TRIP steel.

11. The method of claim 1, wherein the tubing is selectively expanded such that the external diameter of the selectively expanded tubing is at least 5% larger than the external diameter of the unexpanded tubing and wherein the strain hardening exponent n of the formable steel of the tubing is at least 0.16.

12. The method of claim 1, wherein the tubing is selectively expanded inside an underground borehole such that the outer diameter of the selectively expanded tubing is slightly smaller than the internal diameter of a casing that is present in the borehole and any fluids that are present in the borehole and tubing ahead of the expansion tool, are vented to surface via the annular space that remains open around the tubing after the selective expansion process.

* * * * *